US005886280A

United States Patent [19]

Collins

[11] Patent Number: 5,886,280

[45] Date of Patent: Mar. 23, 1999

[54] TRAINING DEVICE FOR USE WITH COMBAT VEHICLES

[76] Inventor: Brooks L. Collins, 1200 Pine Valley Dr., Apt. 136, Elizabethtown, Ky. 40701

[21] Appl. No.: 893,324

[22] Filed: Jul. 16, 1997

[51] Int. Cl.[6] ..... F41A 23/28

[52] U.S. Cl. ..... 89/29; 89/37.03; 89/40.03

[58] Field of Search ..... 89/29, 37.03, 37.07, 89/40.03; 42/77, 75.02

[56] References Cited

U.S. PATENT DOCUMENTS

| | | | |
|---|---|---|---|
| 440,625 | 11/1890 | Emmens | 89/29 |
| 533,171 | 1/1895 | Hurst | 89/29 |
| 1,218,706 | 3/1917 | Semple | 89/29 |
| 2,539,494 | 1/1951 | Summerbell | 42/75.03 |
| 4,325,284 | 4/1982 | Grunewald et al. | 89/37.07 |
| 4,404,765 | 9/1983 | Reudelsterz et al. | 42/77 |
| 4,605,372 | 8/1986 | Nyzell | 89/29 |
| 4,679,487 | 7/1987 | Houseman | 89/140 |
| 4,920,679 | 5/1990 | Sarles et al. | 42/75.02 |

FOREIGN PATENT DOCUMENTS

| | | | |
|---|---|---|---|
| 300180 | 9/1932 | Italy | 42/75.02 |
| 331994 | 7/1930 | United Kingdom | 89/29 |
| WO8501341 | 3/1985 | WIPO | 89/29 |

OTHER PUBLICATIONS

Training Manual, pp. 4–1 to 4–5 May 3, 1990.
Tradoc Pam 71–9, pp. 172–173.

*Primary Examiner*—Stephen M. Johnson
*Attorney, Agent, or Firm*—Scott R. Cox

[57] ABSTRACT

A training device for combat vehicles which can hold a replacement weapon. This training device is comprised of an insertion portion which inserts within the barrel support of the combat vehicle and has secured thereto a holding device for holding a replacement weapon. This training device permits the firing of the replacement weapon with similar firing characteristics to the originally mounted gun. The use of this replacement unit can provide realistic training using less expensive ammunition than that necessary for the original weapon of the combat vehicle.

17 Claims, 5 Drawing Sheets

TRAINING DEVICE FOR USE WITH COMBAT VEHICLES

BACKGROUND OF INVENTION

1. Field of Invention

This invention relates to military training equipment. More specifically, this invention relates to a training device for use with combat vehicles.

2. Prior Art

The military utilizes a large number of combat vehicles with guns firing numerous sizes and types of shells. One of the most important combat vehicles currently in use by the United States military is the M2/M3 Bradley Infantry/Calvary/O.D.S., Fighting Vehicle. The U.S. Marine Corps and Air Force alternative to the M2/M3 Bradley Infantry/Calvary/O.D.S. Fighting Vehicle is a Light Armored Vehicle (LAV) with many similar operational characteristics. Both the M2/M3 Bradley Infantry/Calvary/O.D.S. Fighting Vehicle and the LAV currently use as their main weaponry a 25 millimeter gun.

Because of reductions in the military budget in recent years, fewer and shorter training courses, including fewer hours spent on weapons training, are becoming more the norm in the military. In addition to reducing the amount of training costs, the military is looking for methods to lower its costs. One method for reducing the cost of training is to use less expensive ammunition during training. For example, the cost of using the main weapon of the Bradley vehicle, a 25 millimeter cannon, is approximately $1,400.00 per training session. In contrast, the cost of the standard United States Army M2.50 caliber machine gun is only about $90.00 per training session. While the firing characteristics of these two weapons are not exactly the same, they are sufficiently similar to permit the substitution of the M2.50 caliber machine gun for the 25 millimeter cannon where possible. The cost savings of such a substitution is estimated to be in the millions of dollars each year. Thus, an effective device for securing a M2.50 caliber machine gun to a combat vehicle would be quite useful.

It is important to understand that not all substitutions of weapons would be useful. To achieve the best possible training, the substituted weapon must have similar firing characteristics and similar operational characteristics to the weapon being replaced. Further, the substituted weapon must be securely attached to the combat vehicle so that upon movement by the vehicle, the substituted weapon does not move significantly. The substituted weapon must also permit firing in a pattern similar to the weapon that is being replaced. Finally, the substituted weapon should be inexpensive and readily interchangeable with the weapon being replaced.

One such substituted device is the Reavis subcaliber device for Bradley vehicles described in Tradoc Pam 71-9 published by the United States Army. This Reavis device is a specialized mount for an M16 rifle which is mounted to the main gun trunnion/barrel of the Ms/M3 Bradley Infantry/Calvary/O.D.S. Fighting Vehicle. It is mounted to the barrel by a set of aluminum or steel brackets which are clamped to the main gun turret ring/barrel. This device uses a M16 rifle as a substitution weapon for the main gun of the M2/M3 Bradley Infantry/Calvary/O.D.S. Fighting Vehicle. While the Reavis device is a substitution device for the 25 millimeter weapon, it cannot be used with many current Bradley Fighting vehicles because of mounting problems. In addition, it does not possess similar firing characteristics to the 25 mm weapon of the M2/M3 Bradley Infantry/Calvary/O.D.S. Fighting Vehicle, is expensive to produce and difficult to mount.

A somewhat similar device is designed for use with a tank or other combat vehicle having a fixed main gun. For example, the M179 Telfare is a tank appended device that mounts an M2.50 caliber machine gun to the main gun of a tank or other armored vehicle. The Telfare consists of a base plate, a front mounting yoke, and a transverse and elevating assembly attached to a mounting bracket wherein the bracket is secured to the tank around the barrel of the main gun. However, the mounting bracket of this device cannot be used with the barrel of a combat vehicle, such as the M2/M3 Bradley Infantry/Calvary/O.D.S. Fighting Vehicle.

Another tank appended device mounted using a bracket mounting system is the Brewster M180/M181 subcaliber training device. This device attaches a mounting bracket to the main barrel of an armored vehicle, such as tank. Attached to the mounting bracket is a conventional assault rifle or M55 laser trainer. While this Brewster training device can be useful in situations similar to that of the Telfare device, it cannot be used as a substitution for the barrel of a combat vehicle such as the M2/M3 Bradley Infantry/Calvary/O.D.S. Fighting Vehicle.

WO 85 01341 discloses a subcaliber training device for launchers and similar weapons. This device constitutes a subcaliber anti-armor training device which permits the firing of a 0.22 mm rimfire cartridge from a 66 mm light anti-armor weapon.

Another training means for a weapon is disclosed in U.S. Pat. No. 4,605,372.

As listed in Field Manual 27-1 dated list, a variety of the current devices such as the Thru Sight Video, Multiple Integrated Laser Engagement System (M.I.L.E.S.), Precision Gunnery System (P.G.S.), Videodisc Integrated Gunnery Simulator (V.I.C.S.), Conduct of Fire Trainer (C.O.F.T.), Simulations Network (SIMNET), do not allow crews to perform actual ammunition firing. These devices are at best described as laser simulation gunnery and requires expensive equipment to be mounted on the combat vehicle. Though the military has spent years and millions of dollars to develop and field these simulation devices, they all are still unable to overcome environmental conditions such as rain, fog, dust, and snow.

While these devices are helpful in some training situations, specifically designed training devices for use with a M2/M3 Bradley Infantry/Calvary/O.D.S. Fighting Vehicle or the LAV used by other branches of the military are still necessary.

Therefore there is still needed a subcaliber training device which will replace the main weapon of combat vehicles such as the M2/M3 Bradley Infantry/Calvary/O.D.S. Fighting Vehicle of the Army or the LAV used by other branches of the military.

Therefore, it is an object of this invention to provide a training device for use with combat vehicles.

It is another object of this invention to provide a training device for combat vehicles which simulates the firing characteristics of the main gun of the combat vehicle while using a smaller, less expensive weapon.

It is a still further object of this invention to provide a training device for combat vehicles which is easy to install and sight.

It is a still further object of this invention to provide a training device for combat vehicles which provides realistic training and practice for the individuals who are being trained using that device.

These and other objects and features of the present invention will become apparent to those skilled in the art from a consideration of the following detailed description, drawings and claims. The description along with the accompanying drawings, provides a selected example of construction of the device to illustrate the invention.

SUMMARY OF INVENTION

In accordance with the present invention there is provided a barrel replacement unit for combat vehicles comprised of a. a replacement weapon;

b. an insertion portion for insertion into a gun receiver of the combat vehicle; and c. a holding device secured to the insertion portion for holding the replacement weapon.

In a preferred alternative embodiment of this device an ammunition holding container is also secured to the holding device for holding ammunition to be used with the barrel replacement unit.

This barrel replacement unit for combat vehicles provides an inexpensive, easy to use training device for use with many of the military's combat vehicles. Its use permits inexpensive training with a substitute weapon while still providing realistic training.

BRIEF DESCRIPTION OF THE INVENTION

This invention will now be described with reference to the accompanying drawings in which FIG. 1 is an exploded view of the barrel replacement unit.

DETAILED DESCRIPTION OF THE PREFERRED EMBODIMENT

Figure 1:
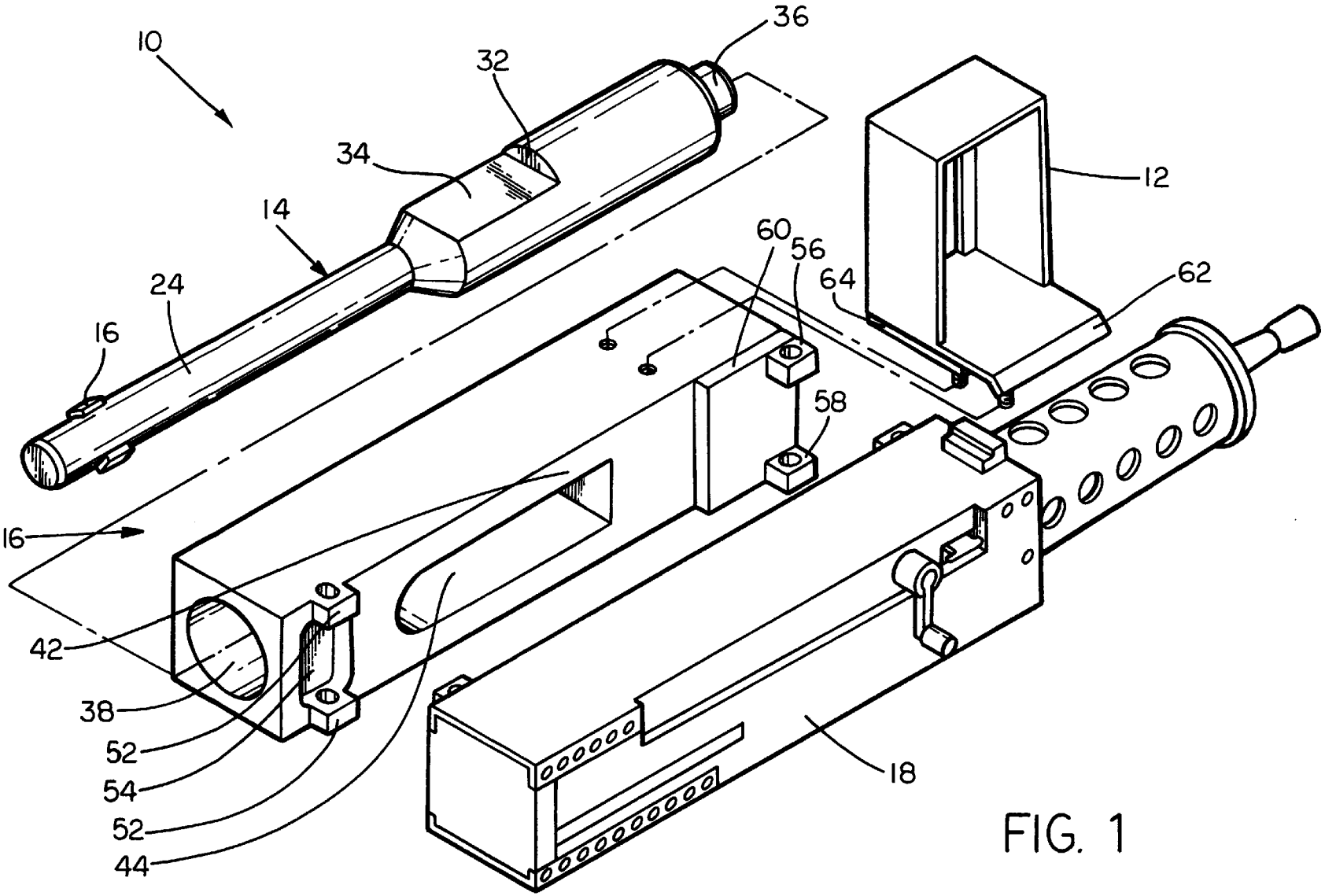

Although the invention is adaptable to a wide variety of uses, it is shown in the drawings for purpose of illustration as embodied in a training device for combat vehicles comprised of a barrel replacement unit (10) and secured thereto in a preferred embodiment an ammunition holding container (12) and a replacement weapon (18). See FIG. 1.

The military has a large number of combat vehicles with guns firing numerous types of shells. For example, the Bradley Infantry Fighting Vehicle currently used by the Army has mounted to it a 25 millimeter main gun. Variations of the M2/M3 Bradley Infantry/Calvary/O.D.S. Fighting Vehicle include the LAV used by the United States Marine Corps and the Air Force, along with modified Bradley Infantry Fighting Vehicles used by the United States. The main gun on these vehicles also uses a 25 millimeter shell. It is an expensive shell and with the current fiscal limitations in the military, the number of firings of the main gun has been limited. The device of the instant invention provides a mounting system for a conventional M2.50 caliber machine gun which will simulate in all material aspects the firing characteristics of the 25 millimeter main gun of the various vehicles.

Figure 2:
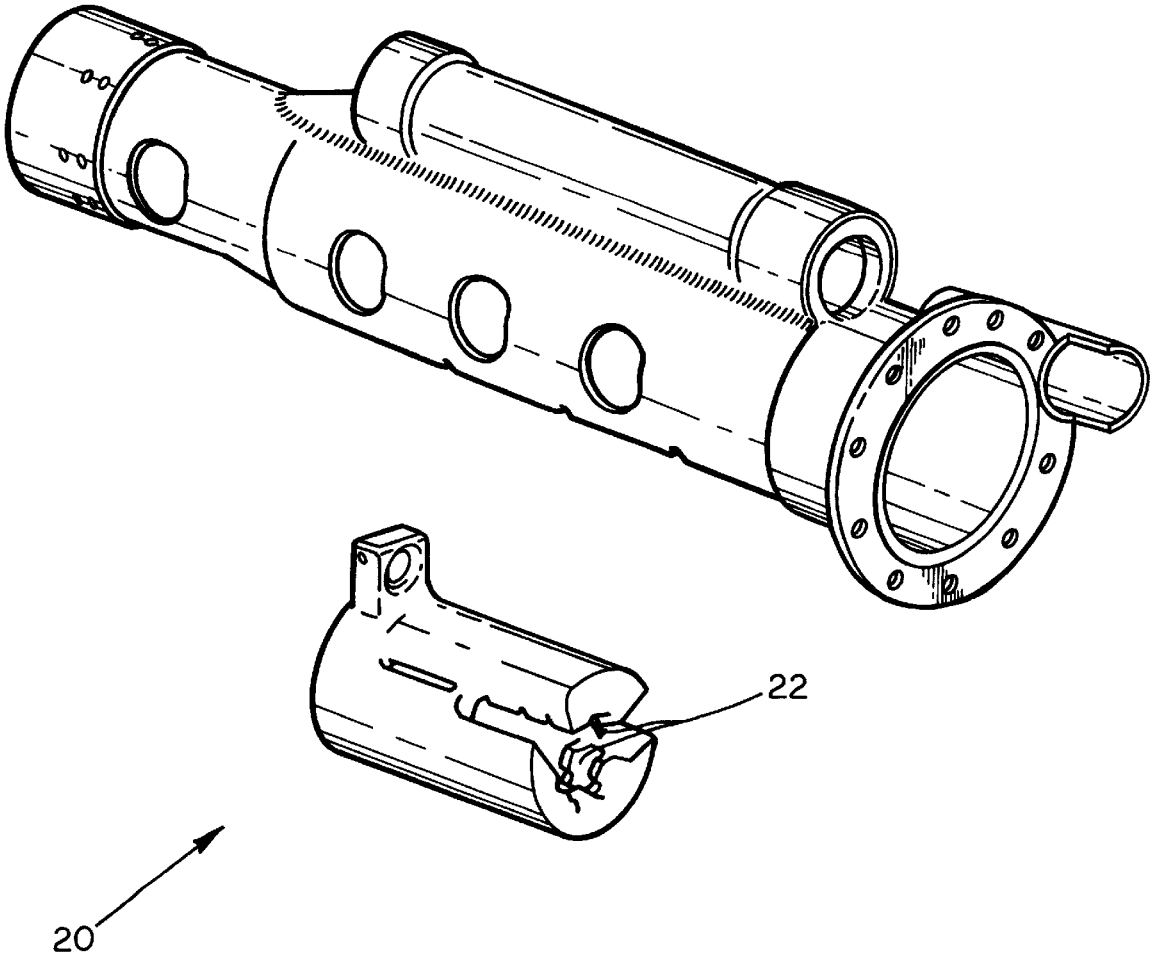
FIG. 2 is an exploded view of the barrel support ring showing the lugs within the barrel support ring which interact with the barrel replacement unit.

The barrel replacement unit (10) is comprised of an insertion portion (14) and secured thereto a holding device (16) for holding the replacement weapon (18), such as a M2.50 caliber machine gun. See FIG. 1. As previously stated, this barrel replacement unit is designed preferably for use with a M2/M3 Bradley Infantry/Calvary/O.D.S. Fighting Vehicle or the LAV used by the United States Marine Corps and Air Force. The gun barrel of the main gun of each of these combat vehicles is secured in place within a gun receiver (20). The gun receiver contains a circular opening into which the gun barrel is placed. The gun receiver has a number of detents (22), preferably three, which project into the opening of the gun receiver. See FIG. 2.

Figure 3:
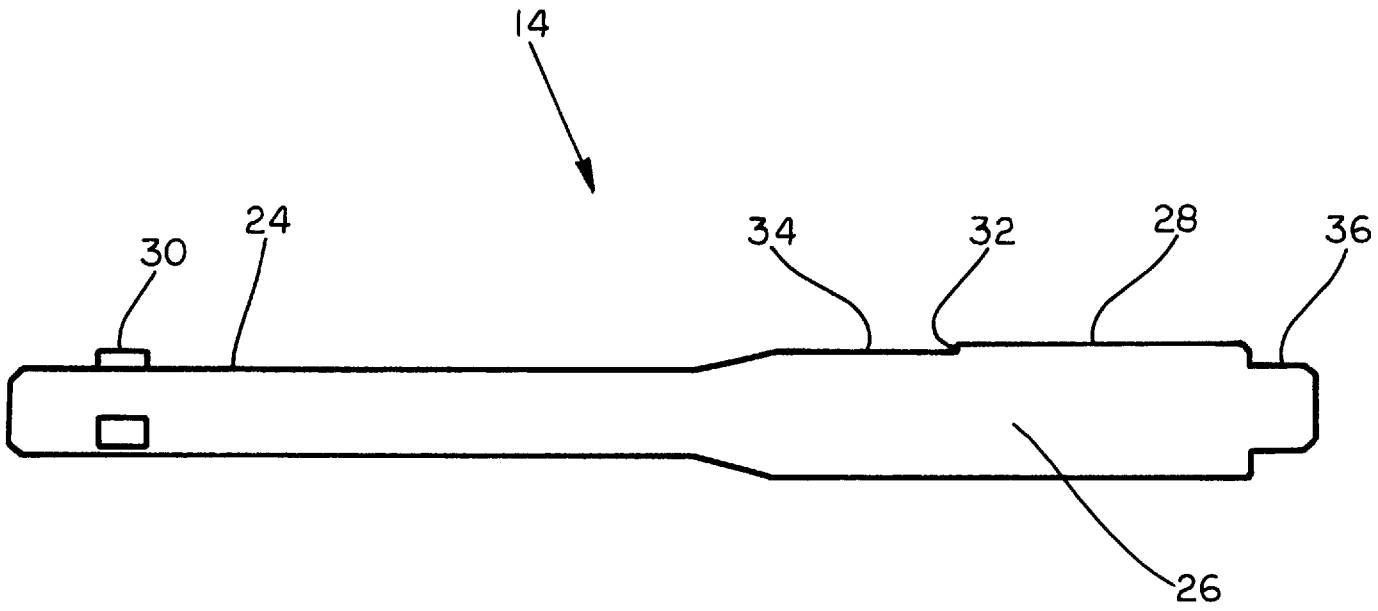
FIG. 3 is a side view of the barrel replacement unit.
Figure 4:
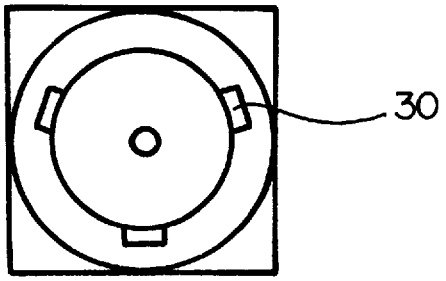
FIG. 4 is an end view of the insertion portion of the barrel replacement unit.

The insertion portion (14) of the barrel replacement unit is generally tubular shaped and is comprised of an inner barrel substitution section (24), an outer joint section (26) and a tubular extension section (28) for merging with the holding device (16). See FIG. 3. The inner barrel substitution section (24) has a number of locking lugs (30), preferably three, which interact with detents (22) in the gun receiver (20) of the combat vehicle to positively secure the barrel replacement unit (10) within the gun receiver. The locking lugs (30) of the inner barrel substitution section (24) project outward from the surface of the generally smooth inner barrel substitution section (24). See FIG. 4. They are located on the inner barrel substitution section (24) at a location to interact with detents (22) of the gun receiver (20) of the combat vehicle. When the insertion portion (14) of the barrel replacement unit (10) is inserted into the gun receiver (20) and then rotated approximately 90°, the locking lugs (30) interact positively with the detents (22) of the gun receiver (20) to hold the barrel replacement unit securely in place. The gun receiver (20) has a release handle (not shown) that is withdrawn to allow the barrel replacement unit (10) to be rotated back to its original insertion position and removed from the gun receiver (20) when removal is necessary.

The insertion portion (14) of the barrel replacement unit (10) is slightly longer (about 10–24 inches) than is the distance from the outside of the gun receiver (20) to the detent portion (22) of the gun receiver (20). This extra length permits the insertion portion to project beyond a gun trunnion. (Not shown) Gun trunnions generally surround the barrel of the weapon of the combat vehicle and are secured to the outside of that combat vehicle. The insertion portion (14) of the barrel replacement unit (10) fits within the gun trunnion and project out from the trunnion at least about 6 inches.

The diameter of the opening in the trunnion is slightly larger than the opening within the gun receiver (20) and thus the insertion portion (14) must be machine beveled to a greater diameter to compensate for this increased diameter to form the outer joint section (26) of the insertion portion (14). It is preferred that the diameter of the outer joint section (26) of the insertion portion be approximately the same size as the opening in the gun trunnion to eliminate as much play as possible in the barrel replacement unit (10) when the vehicle is in motion. In a preferred embodiment, a lip (32) is provided on the outer joint section (26) of the insertion portion (14), about ¼ inch in height. It is located at the end of the outer joint section (26) at a distance from the detents (22) sufficient to allow the lip (32) to be placed against the edge of the gun trunnion to assist in insertion of the unit.

Following the outer joint section (26) of the insertion portion (14) is the tubular extension portion (28) of the barrel replacement unit (10) which is about 6 to about 18 inches in length. On the top surface of the outer joint section (26) is a flattened recessed section (34) approximately 3 to 7 inches in length, about 1 to 2 inches in width and recessed about 1/32 to about ¼ inch. This recessed section (34) is useful when a conventional M2.50 caliber machine gun is attached as it assists in keeping the manual release latch of said machine gun open. The end of the tubular extension portion (28) contains a knob section (36) which is secured within a cylindrical opening (38) in one end (40) of the holding device (16). The knob section (36) is preferable from about ½ inch to about 4 inches in length with a diameter somewhat smaller than the diameter of the outer joint section (26).

Figure 5:
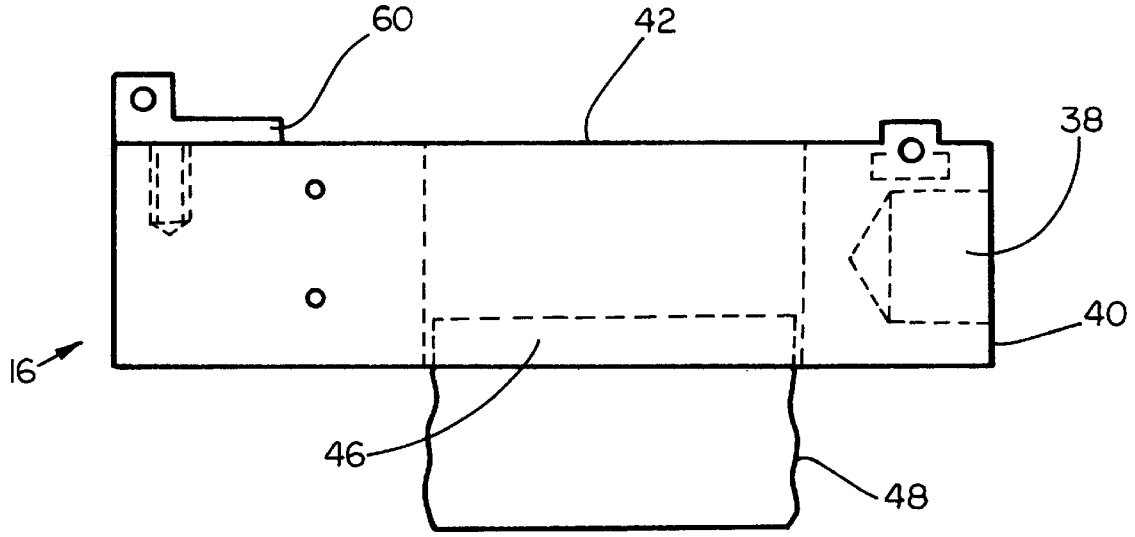
FIG. 5 is a side view of the holding device of the barrel replacement unit.
Figure 6:
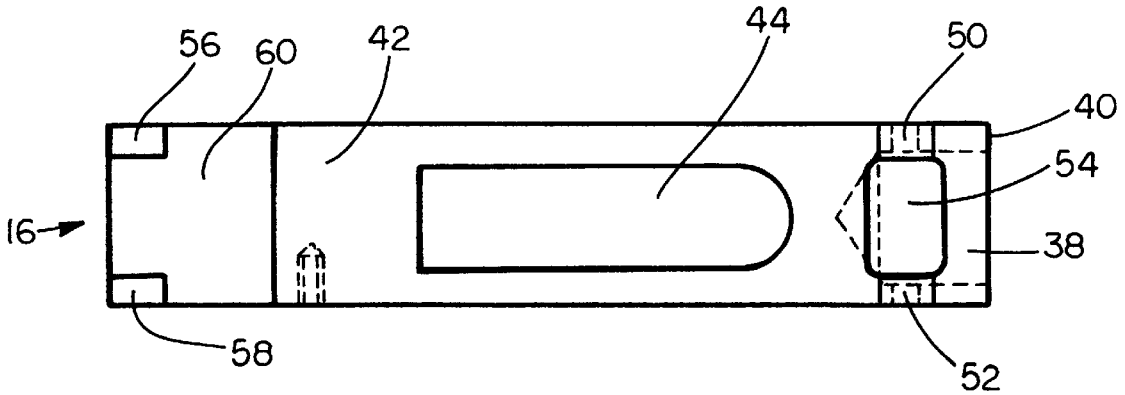
FIG. 6 is a top view of the holding device of the barrel replacement unit.

Secured to the insertion portion (14) is the holding device (16) which holds the replacement weapon (18) which replaces the 25 millimeter barrel of the combat vehicle. See FIGS. 5 and 6. For example, in a preferred embodiment a conventional M2.50 caliber machine gun is secured to the holding device (16).

The holding device (16) is generally a boxlike structure with the cylindrical opening (38) at one end into which the knob section (36) of the tubular extension portion (28) of the insertion portion (14) is secured. The tubular extension portion (28) of the insertion portion can be secured to the holding device (16) by welding, bolting or any other conventional securing method.

The holding device (16) is generally square in cross surface and approximately 3–5 inches in height and width and about 10–20 inches in length. The top surface (42) of said holding device contains an opening (44) about 5 to about 9 inches in length and about 1 to about 3 inches in width which passes through the holding device (16) and includes an opening (46) in the bottom of the holding device (16) of generally the same dimensions. The location of this opening (46) is consistent with a spent casing ejection port in an M2.50 caliber machine gun. In a preferred embodiment, a bag (48) is secured to cover the opening (46) in the bottom of the device (16) conventionally, such as by attaching Velcro to the inside of the opening (46) and to the bag (48) for receiving the spent casings.

At the rear of the holding device (16), near where it is secured to the tubular extension section (28), are a pair of rear mounting brackets (50, 52) and between them a slot (54) approximately ½ to 1½ inches in depth and approximately the same width as is the distances between the rear mounting brackets (50, 52). See FIG. 6. These rear mounting brackets (50, 52) are mounted to the top surface (42) of the holding device (16) near where it is secured to the tubular extension section (28) and are used to hold the rear portion of the M2.50 caliber machine gun in place. Secured to the front portion of the holding device (16) are a pair of front mounting brackets (56, 58), similar in design to the rear mounting brackets (50, 52), for securing the M2.50 caliber machine gun to the holding device (16). No special adaptation of the conventional United States Army M2.50 caliber machine gun is necessary to secure it in place as the mounting brackets (50, 52, 56, 58) correspond to conventional slots in the bottom portion of M2.50 caliber machine guns. To mount the M2.50 caliber machine gun, it is placed between the front and rear brackets and conventional pins are run through the brackets and comparable brackets located in the base of the machine gun to hold it securely in place.

The front brackets (56, 58) are preferably secured to a ballistic elevation plate (60) which is itself secured to the holding device (16) by any conventional securing system such as welding or tap screws, with tap screws being preferable. See FIG. 5. The thickness of the ballistic elevation plate (60) can change the firing characteristics of the weapon secured to the barrel replacement unit (10). Thus, by adjusting the thickness of this ballistic elevation plate (60), the firing characteristics of the weapon can be modified. For example, with a conventional M2.50 caliber machine gun, this ballistic elevation plate (60) should be about ¼ to 1 inch in thickness. In an alternative embodiment, the front brackets (56, 58) and the ballistic elevation plate (60) are constructed as a single unit.

The front (56, 58) and rear (50, 52) mounting brackets can be modified to provide for numerous other types of replacement weapons that can be used with the barrel replacement unit (10). For example, an M-55 laser gunnery trainer or an assault rifle can also be mounted to the holding device (16) by modifying the mounting brackets. For example, a conventional M219 Coax mounting bracket (not shown) can be secured to the side of the holding device (16) by securing it directly to the holding device (16) or by securing it to a steel plate which is itself secured to the side of the holding device (16). This conventional M219 Coax mounting bracket is commonly used to secure assault rifles or other such training weapons to certain military vehicles.

The insertion portion (14) and the holding device (16) of the barrel replacement unit (10) can be manufactured from any conventional strong material, such as tempered steel, aluminum, etc. and, in a preferred embodiment, to reduce the weight of the device aluminum is used for these products.

Figure 7:
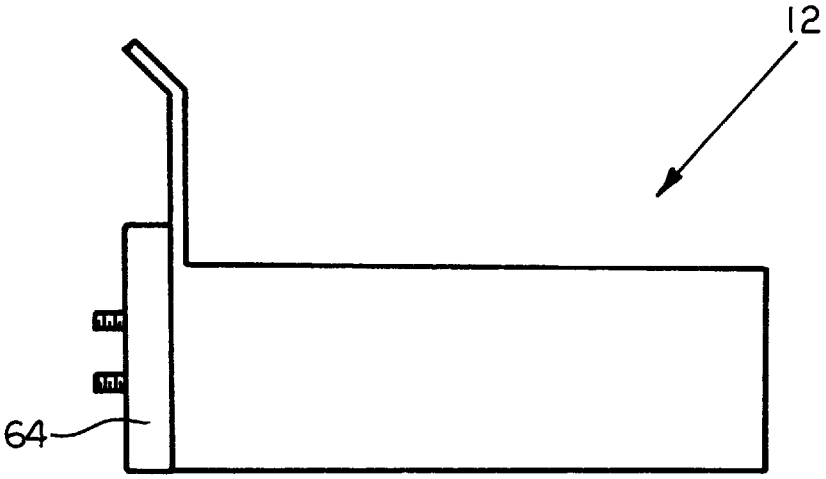
FIG. 7 is a side view of the ammunition holder.

When the M2.50 caliber machine gun is used as the replacement weapon or when any other types of replacement weapons are used which have belt-type ammunition, the ammunition holding container (12) is preferably secured to the side of the holding device. See FIGS. 1 and 7. This ammunition holding container (12) is generally a rectangular, open box-like structure with a C-shaped cross section with ends, which close the device to prevent ammunition from spilling out of the holding container (12). Preferably this ammunition holding container (12) is approximately 5 to about 10 inches in width, 3 to about 7 inches in height and 5 to about 10 inches in length. Obviously, the top portion is open for receiving the ammunition. Secured to the inside top portion of this ammunition holding device (12) is a lip (62) which fits over the top edge of the holding device (12) to provide a clear path for feeding of the ammunition. Secured to both the front and back inside portions of the ammunition holding container (12) are a pair of rails (64) approximately ½ to 1 inch in thickness running generally the height of the inside edge of the ammunition holding container (12). These rails (64) prevent rotation and movement of the ammunition holding container (12) when the combat vehicle is moving.

The ammunition holding container (12) is secured to the side of the holding device (16) by any conventional securing means such as a pair of tap screws running through the inside portion of the ammunition holding container (12) into the side of the holding device (16). See FIG. 1.

The conventional M2.50 caliber machine gun has the capability of being wired for firing without manually depressing the trigger mechanism. In a preferred embodiment, the M2.50 caliber machine gun is wired with the wire running inside of the combat vehicle to the gun plug located on the rear of the gun receiver. This method of wiring provides a better simulation of the firing characteristics of the weapon. The wiring mechanism is conventional to other training devices used with combat vehicles.

In operation, the conventional barrel is removed from the combat vehicle and the insertion portion (14) of the barrel replacement unit (10) is inserted into the gun receiver (20) of the combat vehicle. The insertion portion (14) is rotated approximately 90° to permit the interaction of the locking lugs (30) of the inner barrel substitution section (24) with the detents (22) of the gun receiver (20). This interaction results in a secure platform for any type of weaponry secured to the barrel replacement device (10). In a preferred embodiment a conventional M2.50 caliber machine gun is secured to the holding device (16) of the barrel replacement unit (10) with the front and rear brackets of the M2.50 caliber machine gun placed within the beveled slot (54) and front (56, 58) and rear (50, 52) mounting brackets of the holding device (16). The M2.50 caliber machine gun is secured in place by securing pins through the front and rear brackets of the holding device and through the brackets on the bottom of the M2.50 caliber machine gun. The ammunition used with the M2.50 caliber machine gun is preferably placed within the ammunition holding container (12) and drawn over the lip (62) of that container into the firing mechanism of the M2.50 caliber machine gun. As the M2.50 caliber machine gun is fired, the spent cartridge is preferably passed through the spent casing ejection port of the machine gun into the hollow opening (46) in the holding device into the optional bag (48) for receiving spent casings. The thickness of the ballistic elevation plate (60) can be adjusted to modify the firing characteristics of the ammunition used with the M2.50 caliber machine gun.

Different weapons, such as a M55 laser gunnery trainer, MK19 Grenade launcher or an assault rifle such as an M16 rifle can be alternatively secured to the holding device for providing different operational characteristics for the weapon in use. The trigger of the M2.50 caliber machine gun can be automatically activated by electrical mechanisms which currently exist with the M2.50 caliber machine gun. This electrical wiring runs from the M2.50 caliber machine gun through an existing opening in the fighting vehicle and can be secured to the trigger mechanism within the fighting vehicle. By activation of the trigger mechanism, the M2.50 caliber machine gun will also be activated, thus providing similar characteristics to non-modified combat vehicles without the use of more expensive ammunition.

What is claimed:

1. A barrel replacement unit for combat vehicles comprised of (a) a replacement weapon;

(b) an insertion portion for insertion in a gun receiver wherein the insertion portion is comprised of an inner barrel substitution section, an outer joint section and a tubular extension portion; and (c) a holding device secured to the insertion portion for holding the replacement weapon.

2. The barrel replacement unit of claim 1 further comprising a number of locking lugs secured to the inner barrel substitution section which interact with detents in the gun receiver.

3. The barrel replacement unit of claim 1 wherein the inner barrel substitution section is beveled.

4. The barrel replacement unit of claim 1 wherein the holding device is generally a box-like device with a cylindrical opening in one end into which the tubular extension portion is secured.

5. The barrel replacement unit of claim 1 wherein the holding device is generally rectangular with a generally square cross-section, wherein there is secured to the top surface of the holding device a pair of front brackets and a pair of back brackets and between the front brackets is a slot.

6. The barrel replacement unit of claim 5 wherein there is secured under the back brackets a ballistic elevation plate.

7. A barrel replacement unit for combat vehicles comprised of (a) a replacement weapon;

(b) an insertion portion for insertion in a gun receiver wherein said insertion portion is comprised of an inner barrel substitution section, an outer joint section and a tubular extension portion; and (c) a holding device secured to the insertion portion for holding the replacement weapon.

8. The barrel replacement unit of claim 7 wherein the replacement weapon is a M2.50 caliber machine gun.

9. The barrel replacement unit of claim 7 wherein there is secured to the inner barrel substitution section a number of locking lugs which interact with detents in the gun receiver.

10. The barrel replacement unit of claim 7 wherein the inner barrel substitution section is beveled.

11. The barrel replacement unit of claim 7 wherein the holding device is generally a box-like device with a cylindrical opening in one end into which the tubular extension portion of the insertion portion is secured.

12. The barrel replacement unit of claim 11 wherein there is secured to the top surface of the holding device a pair of front brackets and a pair of back brackets and between the front brackets is a slot.

13. The barrel replacement unit of claim 12 wherein there is secured under the front brackets a ballistic elevation plate.

14. The barrel replacement unit of claim 7 wherein there is an opening running through the holding device.

15. The barrel replacement unit of claim 7 wherein there is secured to the holding device an ammunition holding container.

16. The barrel replacement unit of claim 15 wherein the ammunition holding container is generally an open box-like structure with a C-shaped cross-section with ends closed.

17. The barrel replacement unit of claim 15 wherein said ammunition holding container is secured to the holding device and wherein there is secured between the ammunition holding container and the holding device a front and back rail running approximately the height of an inside edge of the ammunition holding container.

* * * * *